United States Patent [19]

Martin

[11] Patent Number: 4,822,963

[45] Date of Patent: Apr. 18, 1989

[54] VANDAL RESISTANT PUSH BUTTON ASSEMBLY

[75] Inventor: Adolf H. Martin, Glenview, Ill.

[73] Assignee: Adams Elevator Equipment Co., Skokie, Ill.

[21] Appl. No.: 753,505

[22] Filed: Jul. 10, 1985

[51] Int. Cl.[4] ..... H01H 13/04

[52] U.S. Cl. ..... 200/296; 29/622; 200/341

[58] Field of Search ..... 200/296, 330, 331, 340; 29/622

[56] References Cited

U.S. PATENT DOCUMENTS

| | | | |
|---|---|---|---|
| 3,102,173 | 8/1963 | Damon | 200/296 |
| 3,663,780 | 5/1972 | Golbeck | 200/314 |
| 4,417,113 | 11/1983 | Saito et al. | 200/340 |
| 4,480,163 | 10/1984 | Morris et al. | 200/331 |
| 4,504,713 | 3/1985 | Hennessey | 200/241 |

FOREIGN PATENT DOCUMENTS

| | | | |
|---|---|---|---|
| 7618474 | 2/1978 | France | 200/340 |
| 588572 | 1/1978 | U.S.S.R. | 200/330 |

*Primary Examiner*—Renee S. Luebke

*Attorney, Agent, or Firm*—D. R. Lackey

[57] ABSTRACT

A vandal resistant push button assembly, and a method of constructing same in which excess force applied to the button is transferred via a metallic halo into a metallic face plate. The exposed surfaces of the button and halo are spherical, having the same center and radii, providing a smoothly blending curved surface which continues to just below the plane of the exposed face plate surface. A shoulder in the face plate for supporting the halo and enabling the exposed halo surface to enter the plane of the face plate surface is formed by metal displacement, as opposed to metal removal, enabling the required mechanical strength to be achieved with a thinner face plate.

4 Claims, 3 Drawing Sheets

FIG. 3
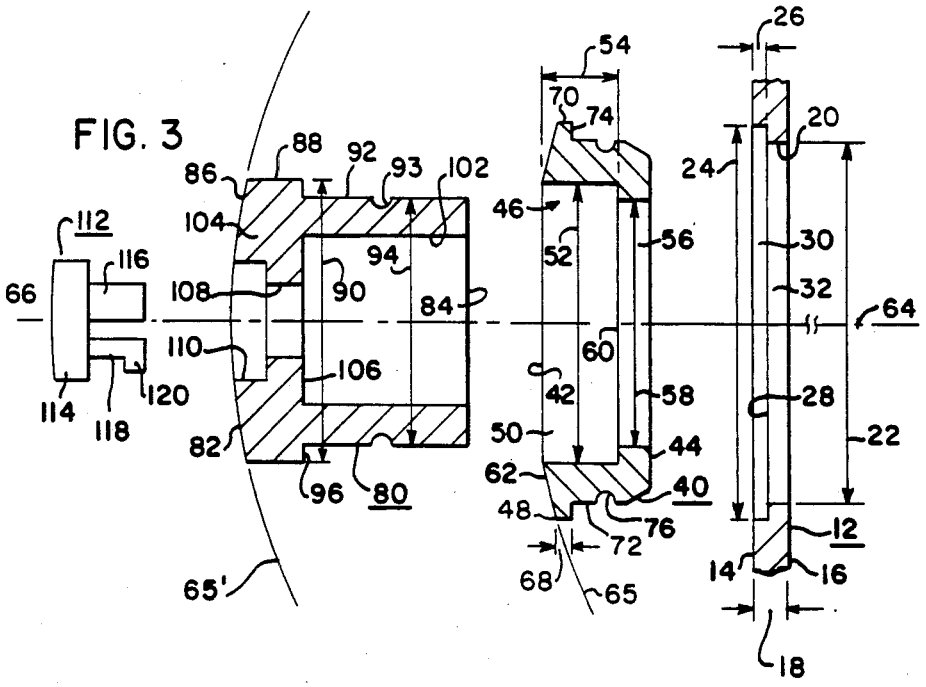
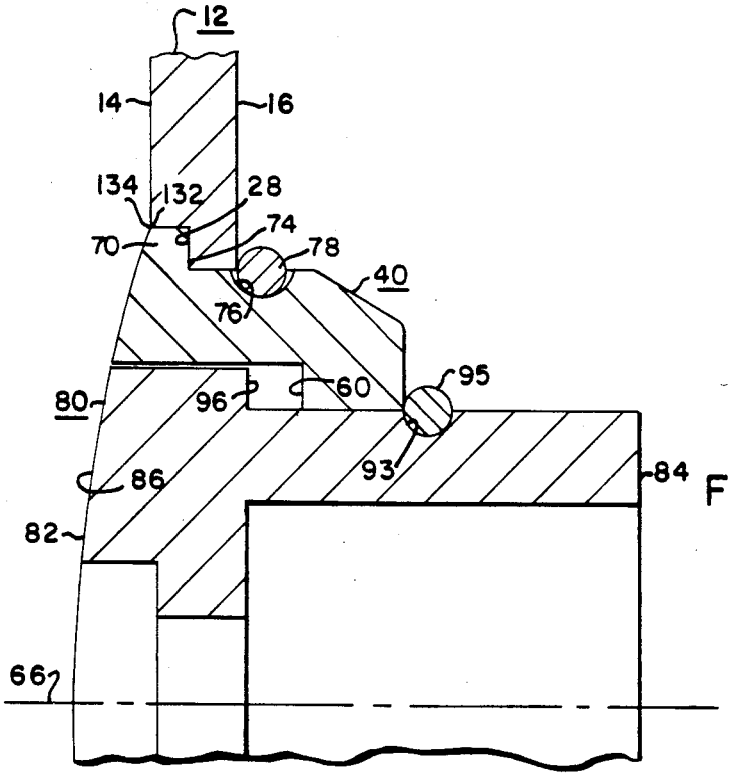
FIG. 4

VANDAL RESISTANT PUSH BUTTON ASSEMBLY

BACKGROUND OF THE INVENTION

1. Field of the Invention

The invention relates in general to push button assemblies, and more specifically to push button assemblies, and methods of making push button assemblies, which are vandal resistant.

2. Description of the Prior Art

Push buttons used by the public, such as the hall call and car call push buttons in elevator systems, are subject to considerable abuse, even when the public is not intentionally trying to destroy them. In certain locations, vandals use hammers, crowbars, chisels, and the like, in a deliberate attempt to destroy and/or remove push buttons from their face plates. While normal push buttons used by the public are constructed to withstand abuse, they will not withstand deliberate attack. Initial approaches to a more vandal resistant push button substituted metal for plastic and a mushroom shaped head on the button. These attempts were not successful. Chisels were used to shear the buttonhead. Hammer blows on the switch button destroyed the electrical switch behind the button, and even broke the welds used to secure studs to the face plate, which studs fixed the position of the electrical switch.

Removing metal from the face plate about the push button, in order to recess parts thereof, is not an economical solution, as it weakens the face plate which is normally used, requiring the use of a thicker face plate than normal. For example, ¼ inch plate may have to be used instead of the normal ⅛ inch plate. Going to a ¼ inch thick face plate requires that the openings in the plate for receiving the push buttons be milled instead of pierced or punched, greatly increasing the fabricating cost as well as increasing the shipping cost, due to the significant increase in weight.

SUMMARY OF THE INVENTION

Briefly, the present invention is a new and improved vandal resistant push button assembly, and a new and improved method of constructing a vandal resistant push button assembly. Conventional ⅛ inch thick steel face plate may be utilized, having one or more pierced or punched openings for mounting push buttons. The face plate has outer and inner major flat surfaces or sides. The edge of each opening on the outer side of the face plate is coined or stamped to create a depression, the bottom of which defines a shoulder spaced a predetermined small dimension from the plane of the outer side of the face plate. Thus, instead of removing metal from the face plate by counterboring the punched opening, the metal about the original opening is displaced or deformed to create the shoulder, with the metal defining the shoulder exhibiting a deformed microstructure identifiable by metalographic etching.

A metallic, tubular halo member is disposed in one of the shouldered openings in the face plate, with the halo having a perimetric flange defining a shoulder which cooperates with the coined shoulder in the face plate, to prevent movement of the halo in a direction from the outer to the inner sides of the face plate.

A metallic button is disposed in the halo, with the button being mounted for rectilinear movement between first and second axial limits. An electrical switch is fixed to the inner side of the face plate. The electrical switch includes bias means which biases the button to the first axial limit, and the switch to a first contact position. External and internal shoulders on the button and halo, respectively, cooperate to define the second axial limit when the button is forced against the bias to cause the electrical switch to change to a second contact position. Excess force applied to the button is transferred to the face plate via the halo, diverting such forces from the electrical switch. Thus, the switch will not be damaged by such forces, and the welds holding the switch mounting studs will not be broken by excess force applied to the button.

The exposed surfaces of the button and halo, accessible on the outer side of the face plate, are spheroidal, having a common center and radii, smoothly blending one to the other when the button is biased to the first axial limit. The diameter of the perimetric flange on the halo is selected to snugly enter the stamped or coined depression in the face plate, continuing the spheroidal surface of the halo slightly below the plane of the outer surface of the face plate, to preclude the forcing of a tool under the halo flange.

BRIEF DESCRIPTION OF THE DRAWINGS

The invention may be better understood and further advantages and uses thereof more readily apparent, when considered in view of the following detailed description of exemplary embodiments, taken with the accompanying drawings in which:

FIG. 3 is an enlarged exploded view, in section, of certain of the components of the assembly shown in FIG. 2;

FIG. 4 is a greatly enlarged fragmentary view of a face plate-halo-button interface shown in FIG. 1;

DESCRIPTION OF THE PREFERRED EMBODIMENT

Figure 1:
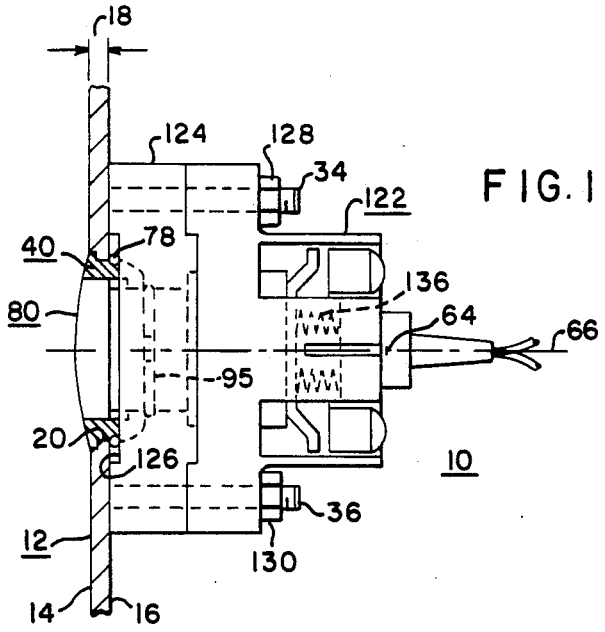
FIG. 1 is a side elevational view of a vandal resistant push button assembly constructed according to the teachings of the invention.
Figure 2:
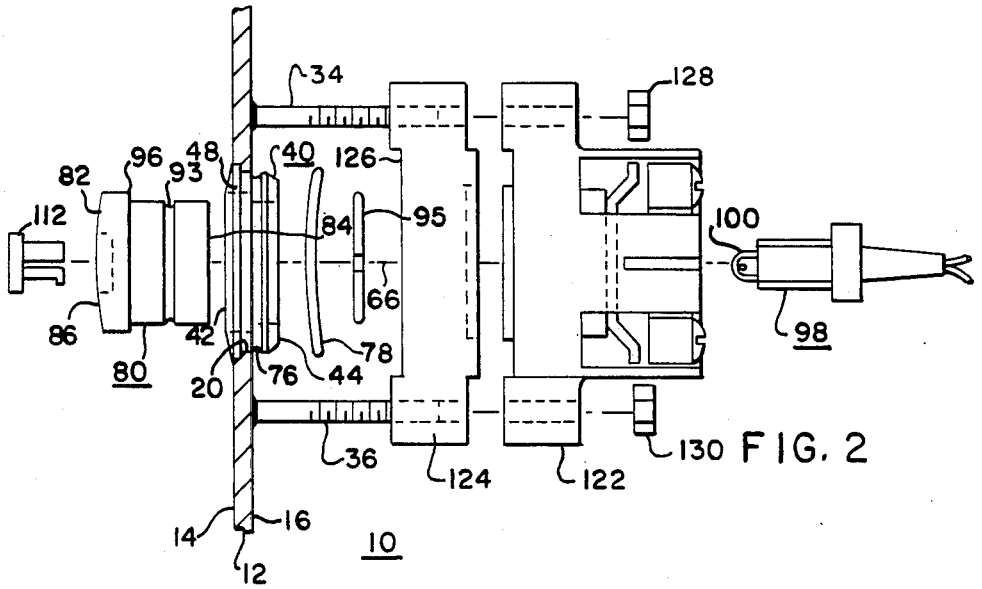
FIG. 2 is an exploded view of the vandal resistant push button assembly shown in FIG. 1.
Figure 5:
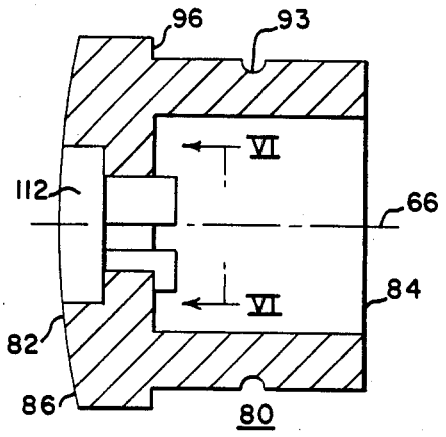
FIG. 5 is a cross-sectional view of the button shown in FIGS. 1, 2 and 3, with a translucent insert disposed at one end of the button.

Referring now to the drawings, FIG. 1 is a side elevational view, partially in section, of a vandal resistant push button 10 constructed according to the teachings of the invention. FIGS. 2–4 will also be referred to while describing push button 10. FIG. 2 is an exploded view of push button 10, FIG. 3 is an enlarged, exploded view, in section, of certain elements of push button 10, and FIG. 4 is a greatly enlarged cross-sectional fragmentary view illustrating the interface between certain of the elements of the push button assembly.

More specifically, push button assembly 10 includes a metallic face plate 12, such as a sheet of stainless steel, brass, hot rolled low carbon steel, or the like. Face plate 12 has first and second flat major surfaces 14 and 16, respectively. The first and second major surfaces 14 and 16 will also be referred to as the outer and inner sides or surfaces, respectively, with the outer side being the side of face plate 12 on which the push button assembly 10 may be actuated by a user.

While certain of the components of push button 10 are dimensioned specifically for use with the selected thickness dimension 18 of face plate 12, the thickness dimension per se of face plate 12 is not critical to the invention. An important advantage of the invention is the fact that the method of constructing push button 10 permits the use of a face plate having a thickness dimension in which openings may be readily pierced or punched, as opposed to milled, while obtaining the requisite vandal resistance. For example, conventional ⅛ inch thick steel sheet may be used, instead of resorting to thicker sheets, such as ¼ inch.

As best shown in FIG. 3, an opening 20 having a diameter 22 is pierced or punched in face plate 12 for each vandal resistant push button assembly 10 to be mounted thereon. Opening 20 is enlarged to a diameter 24 adjacent to the outer side 14 by coining or stamping, i.e., by deforming the metal, as opposed to metal removal by counterboring. The coining or stamping step of the method produces a depression having a predetermined depth or dimension 26, measured from the plane of the outer side 14, creating a shoulder 28 at the bottom of the depression. When the thickness dimension 18 of face plate 12 is ⅛ inch, the depth 26 of the coined or stamped depression may be about 0.025 inch, or about 1/5 of the total thickness of dimension 18. The fact that shoulder 28 is formed by metal flow, i.e., movement or deformation of the metal originally at the end of opening 20, is easily detectable by metalographic etching, as metal flow produces a deformed microstructure in which the arrangement of the precipitates is changed. If the diameter 22 of opening 20, before coining, is 1.156 inches, for example, the diameter 28 of the coined opening immediately adjacent to the outer side 14 may be about 1.246 inches. After the coining or stamping step, opening 20, which will now be slightly less than the original 1.156 dimension, may be viewed as part of a stepped opening in which the face plate 12 defines a first inner surface 30 having an inside diameter 24, which proceeds from the outer side 14 for a predetermined axial dimension 26. After reaching this dimension, the inner surface 30 steps sharply radially inward to second inner surface 32 having a diameter 22, forming shoulder 28 at the sharp transition. The forming of shoulder 28 by flow of the metal is very important, as it economically produces the desired shoulder 28 without weakening the structure to the same extent that reducing the thickness of face plate 12 by metal removal would cause.

As best shown in FIG. 2, first and second threaded studs 34 and 36 are welded to the inner side 16 of face plate 12. As will be hereinafter explained, these are the studs which will hold the electrical switch to the face plate 12.

Vandal resistant push button assembly 10 further includes a metallic, tubular halo member 40 having first and second axial ends 42 and 44, respectively, a stepped opening 46 which extends between its ends and a perimetric flange 48 at its first axial end 42. Halo 40 is preferably formed of a high strength metal, such as stainless steel or brass.

As best shown in FIG. 3, stepped opening 46 in halo 40 has a first inner surface 50 having an inside diameter 52. Inner surface 50 extends inwardly from the first axial end 42 by a predetermined axial dimension 54, and then surface 50 steps sharply radially inward to a second inner surface 56 having a predetermined inner diameter 58, forming a shoulder 60 at the sharp transition.

The surface 62 at the first axial end 42 of halo 40 is spherical with the center 64 of the sphere 65 being on longitudinal center line or axis 66 of the tubular halo 40. The radius of the sphere 65 is 2 inches in an exemplary embodiment of the invention, but other dimensions may be used.

The curved surface 62 forms one side of the perimetric flange 48. The diameter of flange 48 is selected to enter the coined diameter 24 in the face plate 12 with a very close tolerance. Flange 48 has a predetermined axial depth dimension 68 forming an outer surface 70, and then the outer surface 70 steps sharply radially inward to an outer surface 72, forming a shoulder 74 at the transition. An annular groove 76 is formed in outer surface 72, for receiving a spring clip 78, shown in FIGS. 1 and 2. In a preferred embodiment, spring clip 78 is non-flat, i.e., it is bent or bowed relative to a flat plane 79, as shown in FIG. 2. Further, groove 76, as shown in FIG. 4, is slightly wider than the radius used to form the bottom of groove 76. Thus, when clip 78 is forced into groove 76 it will provide a constant pressure or bias between wall 16 of plate 12 and groove 76 which forces flange 70 of halo 40 tightly against shoulder 28 in plate 12. For example, if clip 78 is formed of .051 inch tinned music wire, and an 0.026 inch radius is used to form groove 76, the width of groove 76 may be increased to 0.075 inch. Surface 72, which up to this point has a constant outside diameter, may then taper inwardly to the second axial end 44 to facilitate installation of the spring clip 78.

Vandal resistant push button assembly 10 further includes a metallic, cylindrical button 80 having first and second axial ends 82 and 84, respectively. Button 80, which is preferably formed of stainless steel or brass, has a spherical surface 86 at its first axial end, which is part of a sphere 65′ which has the same radius as the sphere 65 which includes surface 62 at the first axial end of halo 40. The center of spherical surface 86 coincides with the center 64 of halo 40, in a predetermined assembled configuration of these components, as will be hereinafter explained.

Button 80 has a stepped outer surface, including a first outer surface 88 having a predetermined diameter 90, starting at the end of spherical surface 86. Diameter 90 is selected to enter the diameter 52 in halo 46 with a very close tolerance. The outer surface 88, after proceeding at a constant diameter for a predetermined axial dimension, steps sharply radially inward to a second outer surface 92 having a predetermined diameter 94. A shoulder 96 is formed at this sharp transition. Outer surface 92 includes a circumferential groove 93 for receiving a spring clip 95.

Figure 6:
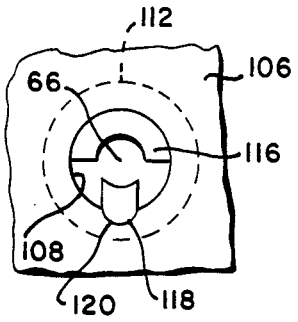
FIG. 6 is an end view of the insert shown in FIG. 5, taken between and in the direction of arrows VI—VI in FIG. 5.

In the embodiment of the invention shown in FIGS. 1, 2, 3 and 5, push button assembly 10 includes a lamp assembly 98, best shown in FIG. 2, having a lamp 100, which, when energized, must be visible at the first axial end 82 of button 80. In a preferred embodiment of the invention, button 80 includes a relatively large opening 102 which extends inwardly from the second axial end 84 for a predetermined dimension to create a wall portion 104 at the first axial end 82, bounded by spherical surface 86 on one side and by wall surface 106 on the other side. A relatively small opening 108 extends between surfaces 86 and 106, with opening 108 being counterbored at 110 adjacent to spherical surface 86. A replaceable translucent insert 112, formed of a high strength plastic, such as polycarbonate, snaps into the counterbored opening 108 from the first axial end of the button. Once the insert 112 is in place, it is removable only from the first axial end while simultaneously releasing it via access through opening 102. Insert 112, shown assembled with button 80 in FIG. 5, and in an end view in FIG. 6 taken between and in the direction of arrows VI—VI in FIG. 5, has a round, disc shaped head portion 114 at one end which is sized to snugly fit the counterbore 110 while smoothly continuing surface 86. Insert 112 has first and second leg portions 116 and 118, respectively, which extend outwardly from the head portion 114. Leg 116 has a curved surface which snugly fits opening 108, and leg 118 is a flexible leg having a foot or extension 120 which extends radially outward from its extreme end. Leg 118 is flexed inwardly during the insertion process, and then foot 120 snaps over the edge of wall 106 when the insert 112 is properly seated. Thus, insert 112 cannot be removed without gaining access to the flexible leg 118, to release the foot 120 and push the insert 112 out the first axial end 120. Thus, it cannot be removed by someone on the external side of face plate 12, but it is easily replaceable by authorized personnel when it is damaged, such as by a cigarette burn.

Figure 7:
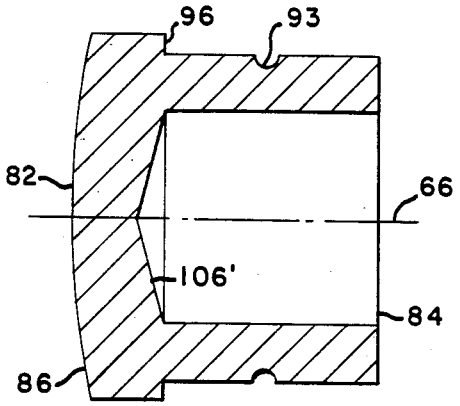
FIG. 7 is a cross-sectional view of a button constructed without a translucent insert.

In another embodiment of the invention, shown in FIG. 7, button 80' is similar to button 80 except it is for use with a push button which does not utilize lamp assembly 98. Thus, push button 80' does not utilize a translucent insert 112, and thus does not require an opening for receiving such an insert. The inner wall 106' need not be perpendicular to the longitudinal center line 66, since it will not function as a locking surface for an insert 112.

Vandal resistant push button assembly 10 further includes an electrical switch 122 which is operated by button 80 from a first or non-actuated position to a second or actuated position. Switch may have any desired combination of normally closed and/or normally open contacts. For purposes of example, it will be assumed that switch 122 is the same switch which is disclosed in detail in U.S. Pat. No. 4,504,713, which is assigned to the same assignee as the present application, and this U.S. patent is hereby incorporated into the present application by reference. Switch 122 is mounted on studs 34 and 36 via an adaptor 124. Adaptor 124 may be similar to the polycarbonate halo which is part of the cover module shown in the incorporated U.S. patent, except the front of the polycarbonate halo is recessed as shown at 126, by the thickness dimension of spring clip 78, in order to prevent interference between the spring clip and the adaptor. Nuts 128 and 130, along with suitable locking washer members, secure switch 122 to face plate 12.

The vandal resistant push button is assembled by inserting button 80 into the close tolerance opening in halo 40 and disposing spring clip 95 into groove 93. The spring clip cooperates with the second axial end 44 of halo 40 to define a first axial limit on the rectilinear movement of button 80 within halo 40. Shoulder 96 on button 80 contacts shoulder 60 on halo 40 to establish a second axial limit to rectilinear movement.

The sub-assembly of the halo and button is then disposed in the close tolerance opening 20 of face plate 12 and spring clip 78 is disposed in groove 76 in halo 40, to secure the sub-assembly firmly to the face plate 12. As hereinbefore stated, spring clip 78 and groove 76 are cooperatively configured to create a continuous bias which urges shoulder 74 of halo 40 tightly against the coined shoulder 28 of face plate 12. It will also be noted in the enlarged fragmentary, cross-sectional view of FIG. 4, that the thickness dimension 68 of the perimetric flange of halo 40 is preferably slightly less than the depth 26 of the coined depression which forms the support shoulder 28, causing the forward edge 132 of the perimetric flange to be recessed slightly below edge 134 which surrounds the coined depression. Thus, a chisel or other tool cannot be used to apply disassembly forces to the halo.

The switch 122 and adaptor 124 are then disposed over studs 34 and 36 and secured with nuts 128 and 130, respectively. The bias means or springs 136 of switch 122 force button 80 to its first axial limit defined by contact between the spring clip 95 and the second axial end 44 of halo 40. Since surface 62 of halo 40 and surface 86 of button 80 are spherical, and since they have the same center and radii, their curved surfaces blend and flow smoothly from one to the other, terminating just below the plane of the outer side or surface 14 of face plate 12. Thus, a chisel or other tool cannot engage either the outer edge of halo 40 or the outer edge of button 80. Further, button 80 can only travel against the spring bias until shoulders 96 and 60 of the button and halo, respectively, engage. This travel distance is selected to be sufficient to change the contact condition of switch 122 from normally open to normally closed, or vice versa. Any force applied to button 80 in excess of the force required to cause shoulders 96 and 60 to contact one another, is transferred from the button 80 into the halo 40, and from the halo 40 to the face plate 12. Thus, no excess forces are applied to switch 122, or to the welds which hold studs 34 and 36 to the face plate 12.

I claim:

1. A vandal resistant push button assembly, comprising:

a metallic face plate having a predetermined thickness dimension;

said face plate having first and second sides each defined by a major flat surface, and an opening which extends between said first and second sides, said opening including a first shoulder immediately adjacent to said first major surface, with the metal defining the shoulder exhibiting a deformed microstructure caused by displacement of the metal originally surrounding the opening;

a metallic halo;

said halo being a tubular member having first and second axial ends, a stepped inner surface which extends between its ends, and a stepped outer surface which extends between its ends;

the stepped outer surface of said halo having a first outer surface which starts at the first end of the halo, said first outer surface stepping sharply inward to a second outer surface, after a predetermined dimension from the first end, defining a second shoulder at the transition between said first and second outer surfaces, said dimension between the second shoulder and the first end not exceeding the dimension between the first major surface of the face plate and the first shoulder;

the stepped inner surface of said halo including a first inner surface starting at the first end of said halo, said first inner surface stepping inwardly to a second inner surface after a predetermined dimension from the first end, defining a third shoulder at the transition;

means fixing said halo in the opening defined by said face plate, with the first and second shoulders in contact with one another;

a metallic push button having first and second axial ends and a stepped outer surface, the stepped outer surface of said button including a first outer surface starting at its first end and stepping radially inward to a second outer surface after a predetermined axial dimension, defining a fourth shoulder at the transition;

means mounting said button within the opening defined by said halo, for movement between first and second axial limits, with the means which mounts said button in said halo contacting the second end of said halo to define the first axial limit, and with contact between the third and fourth shoulders defining the second axial limit;

the first ends of said button and said halo defining surfaces which flow smoothly from one to another when the button is at the first axial limit;

and an electrical switch fixed to the second major surface of said face plate, said electrical switch including bias means which biases said button to the first axial limit, said electrical switch being in a first position when the button is at the first axial limit and a second position when the button is advanced against the bias of the bias means by an external force to the second axial limit defined by contact between the third and fourth shoulders.

2. The push button assembly of claim 1 wherein the means fixing the halo in the opening defined by the face plate biases the second shoulder of the halo against the first shoulder of the face plate.

3. A method of constructing a vandal resistant push button assembly, comprising the steps of:

providing a metallic face plate having outer and inner surfaces and a predetermined thickness dimension;

punching an opening in said metallic face plate;

coining the edge of the opening on the outer surface of said face plate to form a shoulder;

providing a metallic halo having a perimetric flange;

disposing said metallic halo in the opening, with the perimetric flange being supported by the coined shoulder, and with the edge of the flange being slightly below the plane of the outer surface of the plate;

mounting a metallic button in said halo for rectilinear movement between predetermined first and second axial limits;

seating said button on said halo at the second axial limit, with said halo transferring additional forces applied to the button to the face plate;

fixing an electric switch to the inner surface of the face plate;

and biasing said button via said electrical switch to the first axial limit, wherein the surfaces of the button and halo flow smoothly from one to the other, to just below the plane of the outer surface of the face plate.

4. The method of claim 3 wherein the step of disposing the metallic halo in the face plate opening includes the step of fixing the halo in the face plate opening to provide a continuous bias between the perimetric flange of the halo and the coined shoulder of the face plate.

* * * * *